US005838247A

United States Patent [19]

Bladowski

[11] Patent Number: 5,838,247

[45] Date of Patent: Nov. 17, 1998

[54] SOLID STATE LIGHT SYSTEM

[76] Inventor: Witold S. Bladowski, 11 Wilson Court, Barrie, Ont., Canada, L4N 5K8

[21] Appl. No.: 831,385

[22] Filed: Apr. 1, 1997

[51] Int. Cl.[6] ..... G08B 5/22

[52] U.S. Cl. ..... 340/815.45; 340/473; 340/701; 340/782; 340/925

[58] Field of Search ..... 340/815.45, 782, 340/701, 907, 935, 912, 901, 905, 332, 925, 473, 472

[56] References Cited

U.S. PATENT DOCUMENTS

| | | | |
|---|---|---|---|
| 4,298,869 | 11/1981 | Okuno | 340/782 |
| 5,036,248 | 7/1991 | McEwan et al. | 313/500 |
| 5,136,287 | 8/1992 | Bornstein | 340/925 |
| 5,184,114 | 2/1993 | Brown | 340/701 |
| 5,457,450 | 10/1995 | Deese et al. | 340/912 |
| 5,528,474 | 6/1996 | Roney et al. | 362/249 |
| 5,633,629 | 5/1997 | Hochstein | 340/907 |

*Primary Examiner*—Jeffery A. Hofsass
*Assistant Examiner*—Davetta Woods
*Attorney, Agent, or Firm*—D. W. Eggins; D. Eggins

[57] ABSTRACT

A lamp comprising an array of solid state lights, using light emitting diodes (LED's) has a massed arrangement of LED lights, the number of which may exceed the capacity of the face area of the lamp, such that a high intensity of light is achieved, being accomodated within the envelope of the lamp by being positioned at an angle from the face of the lamp. In one system embodiment, as a replacement for, and using the form of an incandescent lamp, the LED lights are mounted in substantial coincidence with the shape of the incandescent lamp reflector, to provide an area of light source concentration larger than the projected area of the lamp. In another embodiment for a lamp having a circular face, such as a traffic light, the massed lights are arranged as an annular strip facing inwardly towards the polar axis of the lamp. A conical reflector directs the light outwardly, to provide the required intensity of illumination. More than one such annular light strip may be provided, such as two concentric annuli, with inclined reflectors positioned to direct the light in the desired direction. Semi-reflecting reflectors may be used, to permit the through passage of supplemental light from underlying light sources. These intensified LED lighting systems lend themselves to a wide range of applications.

14 Claims, 8 Drawing Sheets

PRIOR ART (FIGS 1-4)

SOLID STATE LIGHT SYSTEM

FIELD OF THE INVENTION

This invention is directed to a solid state light system, using light emitting diodes (LED's), and in particular to a high intensity solid state light system.

BACKGROUND

Widespread use is made at present of incandesent lamps. Such lamps depend upon the heating of a wire filament to a high temperature, so as to emit light.

These lamps are not very energy efficient, and because of their reliance upon the heating of a hot wire, they generate much heat, which adversely affects their service life, while also frequently posing secondary problems in regard to dissipating the heat thus generated.

Certain types of incandescent lighting service have been replaced by fluorescent lights, which achieve significantly higher efficiencies. These type of lights however usually require the provision of a ballast, in order to regulate the applied voltage so as to achieve the start-up of the lamp, and to regulate the current during the steady-state operation of the lamp.

The requirements of ballast systems generally militate against use of fluorescent lamps for other than steady state illumination. Also, the inherent requirements of fluorescent lamps, including start-up time, and significant size and shape limitations severely limit such lamps in their application to specialty situations. Solid state, light emitting diodes (LED's) provide low intensity, "cool" light from very small lamps. However, their uses have been limited, owing to the low intensity of the light generated. Representative of the present state of the art are: 1) the LED's available from Ledtronics of Torrance, Calif. 90505 (ZIP); 2) an article in IAEEL Newsletter (International Association for Energy Efficient Lighting) Issue 12 Vol 4 by Fredrik Lundberg of Stockholm Entreprenad, entitled "Sixty percent less energy with LED traffic lights"; and, 3) U.S. Pat. No. 5,457,450 Oct. 10 1995 Deese et al, which deals with compensatory switching methods for LED lamps, under brown-out, voltage- drop conditions, when their emissivity can drop catastrophically.

One of the existing drawbacks of LED's when in competition with incandescent lights, is their relatively lower illumination intensity.

In the Lundberg article and in the Deese et al patent, referred to above, traffic light LED arrays are illustrated as being of pizza-like arrangements, wherein the total mass of LED's is limited by the diameter of the standard light fixture. This diametric limitation is even more restrictive in Europe than in North America, owing to the smaller size lamps used in Europe.

SUMMARY OF THE INVENTION

The present invention provides a lamp for use in illumination, having a polar axis of light propagation, and a projected area of light generation substantially normal to that polar axis, comprising a mass of solid state lamps arranged in close mutual proximity as a strip of lamps of predetermined width, the strip being positioned at an angle to the plane of the projected area, in use, when energized to cumulatively generate a high intensity light.

In the preferred lamp system the solid state lamps comprise LED's. In one embodiment the lamp has a body portion shaped as an arcuate or parabolic reflector located in facing relation with the projected area of the lamp, as constituted by its lens, wherein the strip of lamps substantially cover at least a major portion of the surface of the body portion, the lamps being interposed between the body and the lamp face, to emit light outwardly towards the lens.

In an embodiment having the individual LED lights inclined to the polar axis of the lamp, the lamp may include reflector means to direct light emitted by the LED's in a direction substantially parallel to the polar axis.

The aforesaid strip of lights may be positioned about the periphery of the lamp body, and positioned at an angle to the plane of the lens or frontal area.

The lamp reflector means, located within the lamp, are generally inclined at an angle from the strip of LED's to reflect the light emitted thereby in a direction substantially parallel with the polar axis of the lamp.

In one lamp embodiment the strip of lights is positioned substantially normal to the plane of the lamp face, i.e. generally parallel with the polar axis of the lamp.

The lamp may comprise a plurality of the strips of LED's, arranged in mutually concentric relation and having light reflector means located in interposed relation between the strips.

The lamp, containing a plurality of the strips, may be arranged with the strips in mutually concentric relation, and having light reflector means located in interposed relation between the strips. The lamp light reflector means may include one or more semi-reflectors, permitting the passage of light therethrough, whereby layers of such units may be superimposed, as a form of sandwich. The characteristics of LED lights, when arranged as described, provide higher intensities, making them suitable for a range of uses.

One particular use is in traffic lights, where the long life characteristics of LED's, their suitability for repetitive switching, their lower temperature operation and their higher efficiency all contribute to qualify them for such use.

Owing to the achieved quality of compaction, and the ruggedness of the units, particularly when assembled upon a printed circuit board, their use in vehicle turn signals is contemplated, where the signal lamp may be located in more exposed locations, without requiring extensive protective housings. This is of significance when accidental damage to vehicle fenders occurs.

A further field of potential use is in Recreational Vehicles (R.V's), where the higher cost of massed LED's can be justified in view of the lower current draw, the low profile that can be achieved, and the low operating temperature, which permits the LED lamps to be recessed into the ceiling. In an R.V. context, the burning of incandescent light covers is commonplace, due to the associated large heat build-up in poorly ventilated, compact lamps.

A further quality of LED's which extends the potential field of use of the higher intensity lamps is the range of available colour characteristics.

It is contemplated that in uses such as automotive turn signals, the direct generation of coloured light by selection of the type of LED may make redundant the need for coloured lenses, with consequent improvements both in efficiency, visibility and cost.

BRIEF DESCRIPTION OF THE DRAWINGS

Certain embodiments of the invention are described by way of illustration, without limitation of the invention thereto other than as set forth in the claims, reference being made to the accompanying schematic drawings, wherein;

FIGS. 1 through 4 are illustrations of PRIOR ART, in which:

FIG. 1 is a plan view of a Prior Art "pizza-like" arrangement for an LED lamp;

FIG. 2 is a side elevation of a typical commercial LED light;

FIG. 3 is an exploded view, in side perspective, of a traffic lamp, incorporating a planar, pizza-like LED lamp;

FIG. 4 is a mid-section plan view of the lamp of FIG. 3:

DETAILED DESCRIPTION OF THE INVENTION

Figure 1:
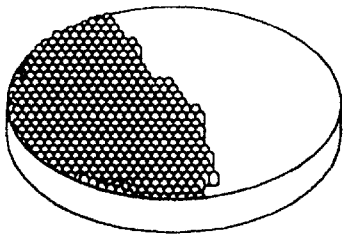
Figure 2:
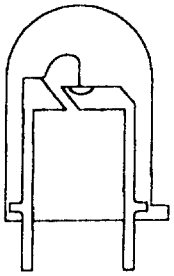
Figure 3:
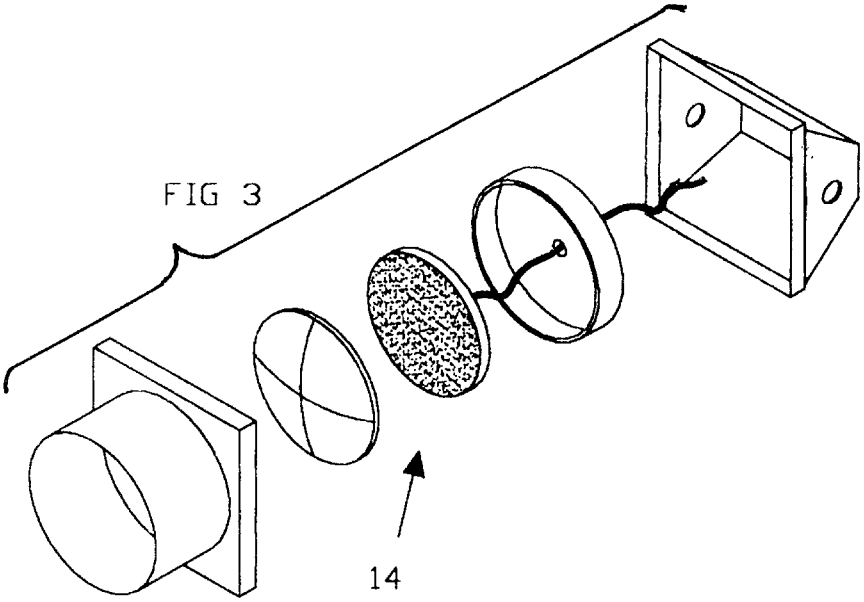
Figure 4:
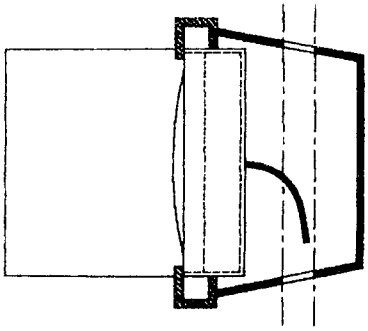

Referring first to the prior art utilization of LED lights, as illustrated in FIGS. 1 through 4, FIG. 1 shows a planar pizza-like assembly 10 of LED's, as a disc form comprising a mass of LED lights, such as the light 12, shown in FIG. 2. The total light output of the lamp 14 of FIGS. 3 and 4 is limited to the number of LED ligate 12 that can be mounted on the face of the disc 10 of the lamp 14.

Figure 5:
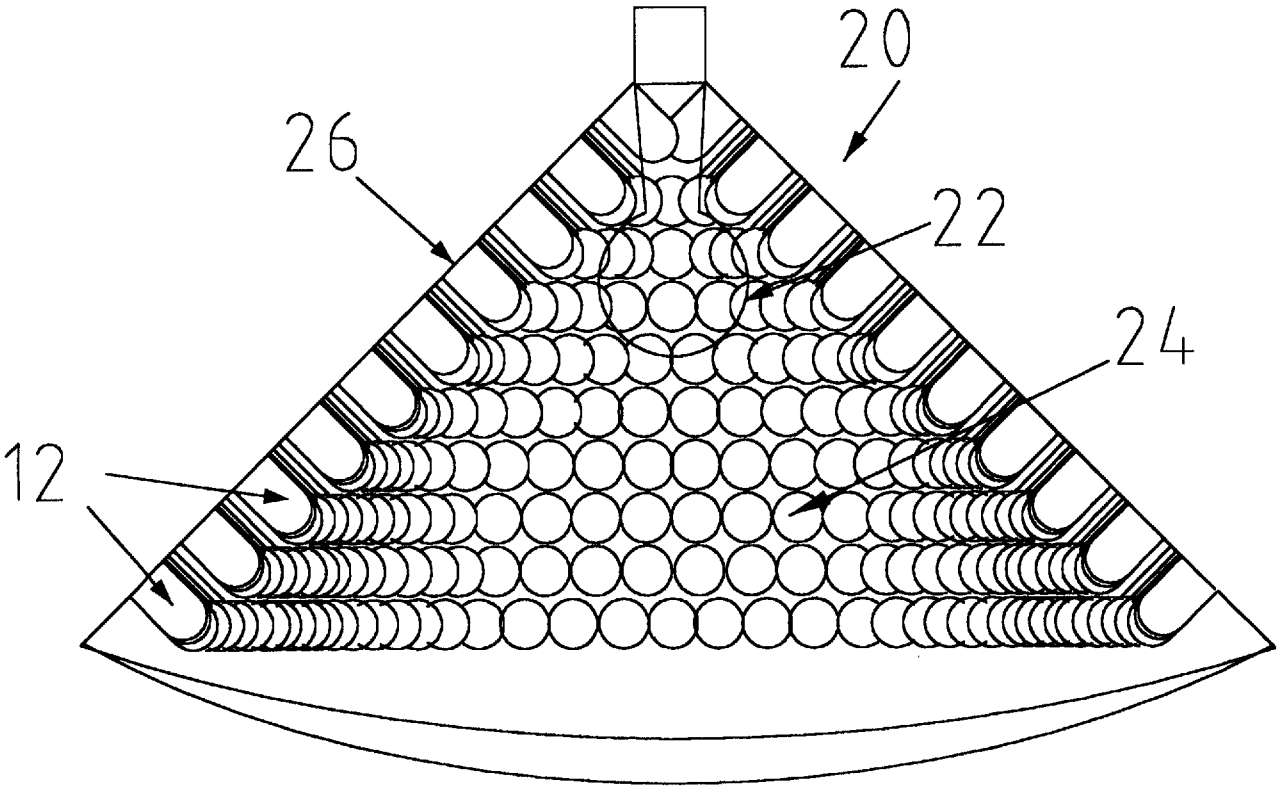
FIG. 5 is a first embodiment of a high intensity LED lamp in accordance with the present invention, retro-fitted within an existing housing, and shown in diametrical section.

Referring now to FIG. 5, a lamp 20 of a form previously having an incandescent bulb 22 (shown diagramtically, in phantom), is furnished with an array 24 of LED lights 12 arranged in accordance with the present invention, to cover the interior of surface 26 of the lamp 20.

The surface 26 being an inclined surface of conical, arcuate or parabolic shape, it will be evident that the surface area available to receive lights 12 exceeds the projected cross-sectional area of the lamp 20. Thus, in most instances, the light intensity of the lamp 20 will be correspondingly boosted.

The reflective and focussing characteristics of the interior of surface 26 may be supplemented by the adoption of individual reflective and/or refractive lens portions for the individual lights 12.

Figure 6:
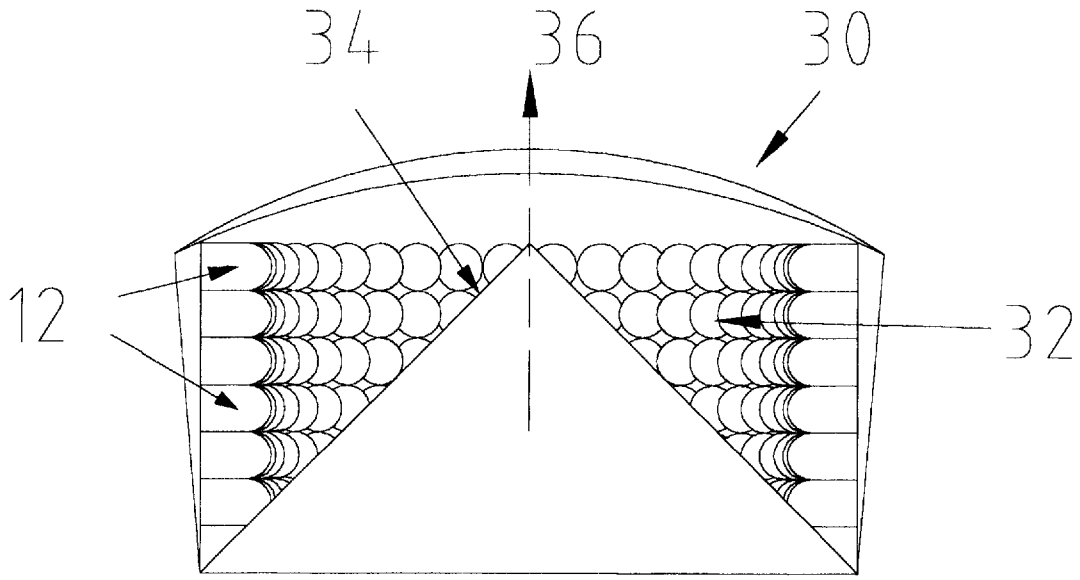
FIG. 6 through 11 are a diametrical side sections of a second, third, fourth, fifth, sixth and seventh embodiment of an LED lamp in accordance with the present invention.

Referring to FIG. 6, a circular lamp 30 has an annular array 32 of lights 12 positioned around its interior. The useful surface area of the array 32, as defined in terms of the number of its lights 12, may significantly exceed the useful area of the lamp 30, i.e. the projected cross-sectional area of lamp 30.

Figure 7:
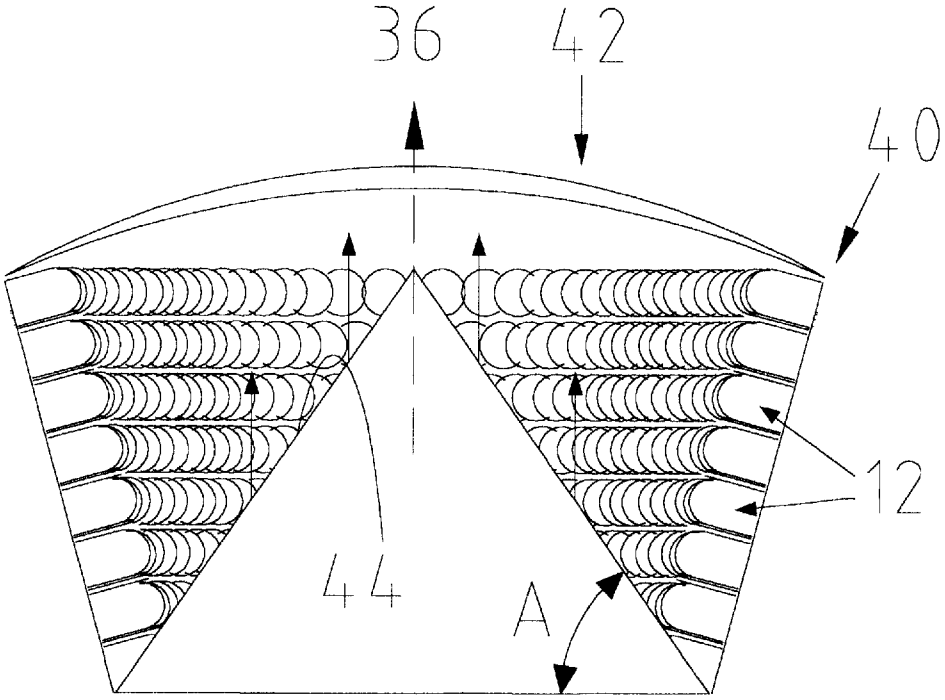

A reflector 34, illustrated as being conical, of 45 degree angle, serves to direct the light emission from the lights 12 parallel to the polar axis 36 of the lamp 30. Pyrimidal forms are feasible. In the FIG. 7 embodiment, a lamp 40 has an inclined (conical) array 42 of lamps 12, with a reflector 44 inclined at a complementary angle A, so as to direct the light parallel to the polar axis 36 of lamp 40. The array 42 of lamps 12 is illustrated as being divergently inclined (i.e.—conical or pyramidal). However, it will be understood that the array 42 may be the inverse, i.e. convergently inclined; and conical or pyrimidal. The angle of convergence or divergence may vary, with the angle of the reflector correspondingly selected to achieve the desired direction and type (e.g. focussed or diffused) of light output.

In the case of lamps 20, 30 and 40, and further embodiments described below, where such lamps according to the invention are used as replacement sources of light in existing fixtures, such as traffic lights, the lens size, and the corresponding effective cross-sectional projected area of the pre-existing fixture may constitute one of, if not the limiting parameter of the LED-array replacement lamp, which has to be restricted to the dimensions of that fixture.

Figure 8:
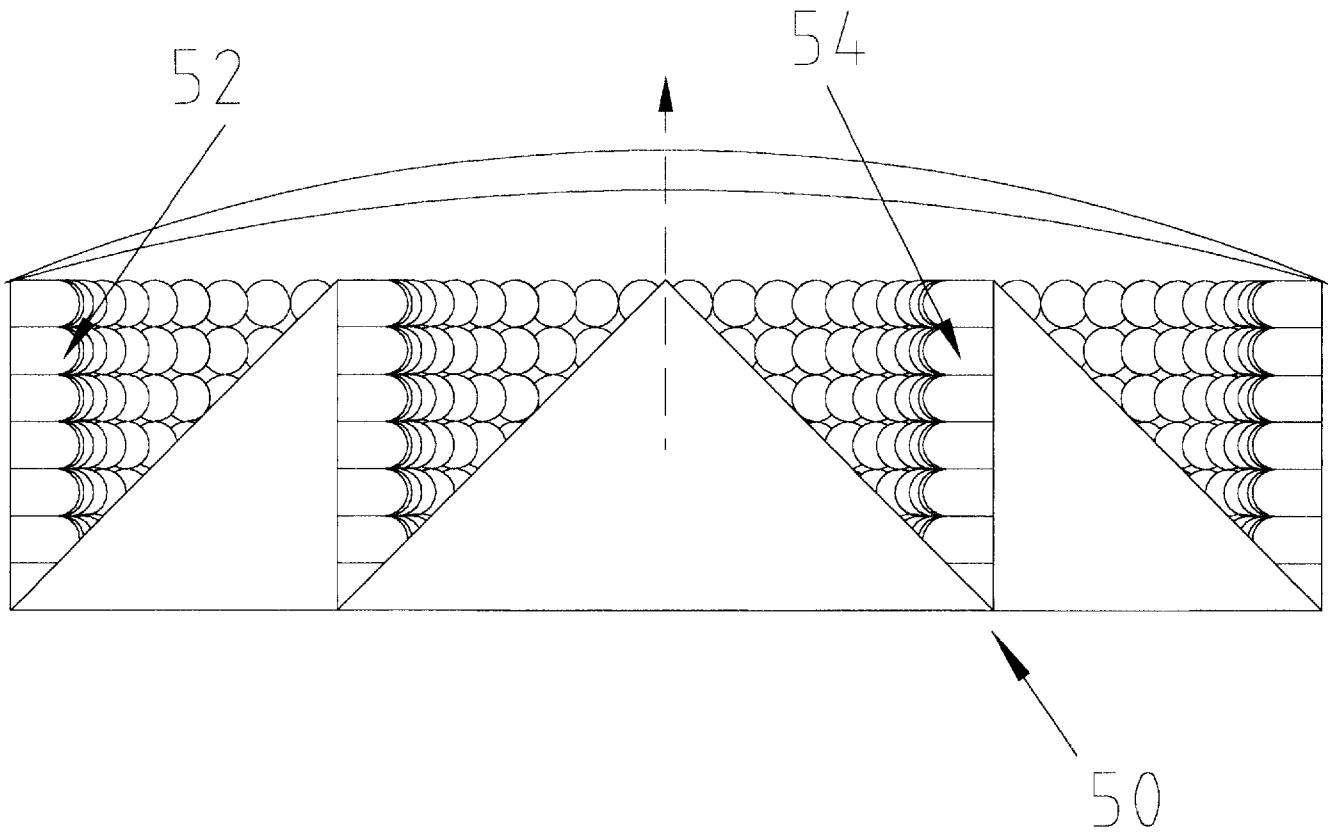

Turning to FIG. 8, an LED lamp 50 is shown having two, concentric annuli 52, 54 of LED lights. In many instances the diameter of the lamp fixture permits such an arrangement.

In the illustrated arrangement the annuli 52, 54 are parallel to the polar axis of the lamp 50, and the reflectors in that instance may comprise 45° degree annuli. As commented upon earlier with reference to the FIG. 7 embodiment, different angular arrangements of lights and reflectors may be employed.

The use of more than two such concentric annuli of lights is possible. The term "concentric" is also intended to refer to and cover non-circular and even straight-sided arrangements of the LED lights.

Figure 9:
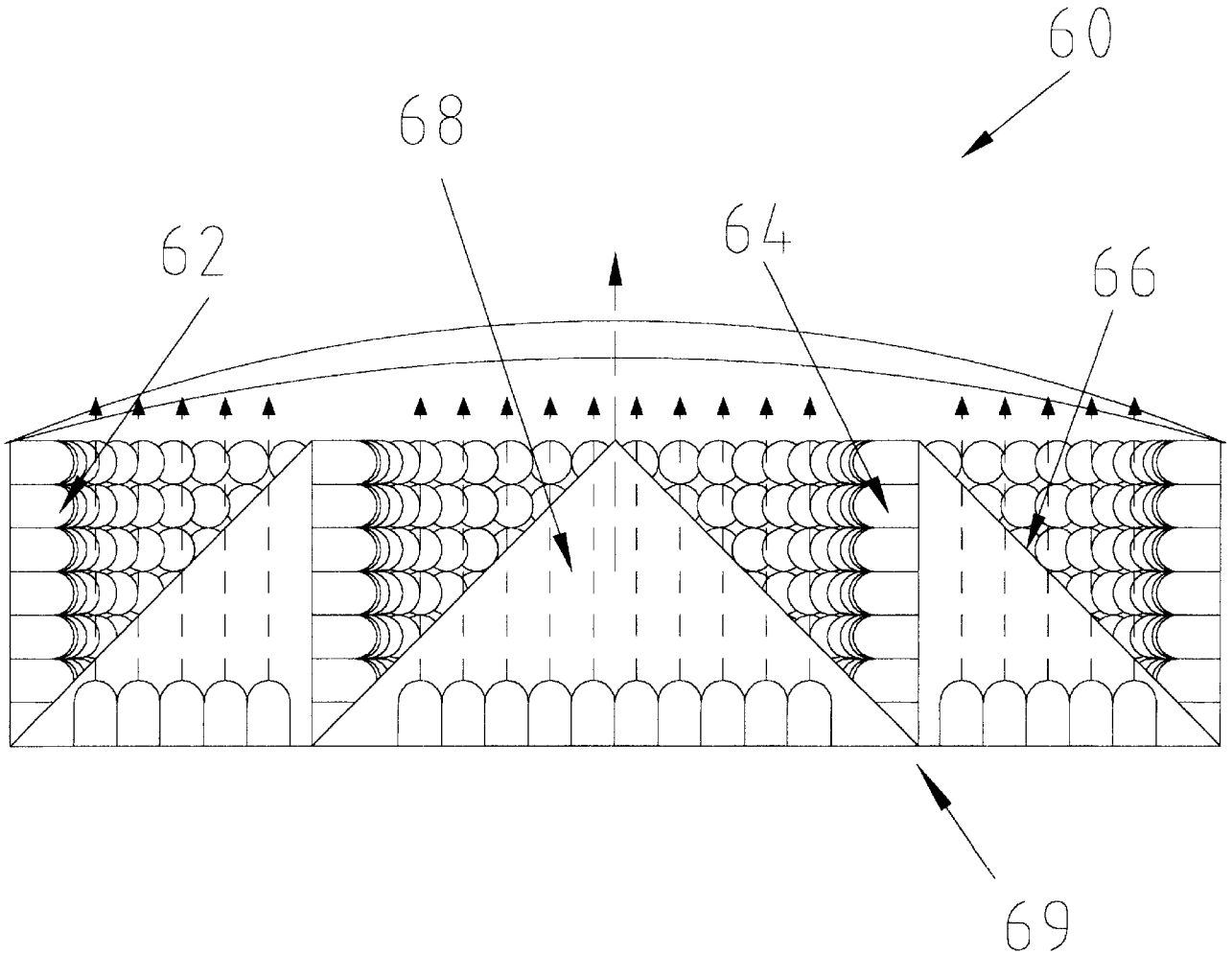

FIG. 9 shows an LED lamp 60 having two annular light strips 62, 64, with inclined annular reflector surfaces 66, 68 to reflect the light in a substantially polar direction.

A supplemental (bottom) LED light array 69 may be provided, the surfaces 66, 68 being semi-reflective, to permit the outward passage of light emitted by the lights of the array 69 as a supplemental emission of the lamp 60.

Figure 10:
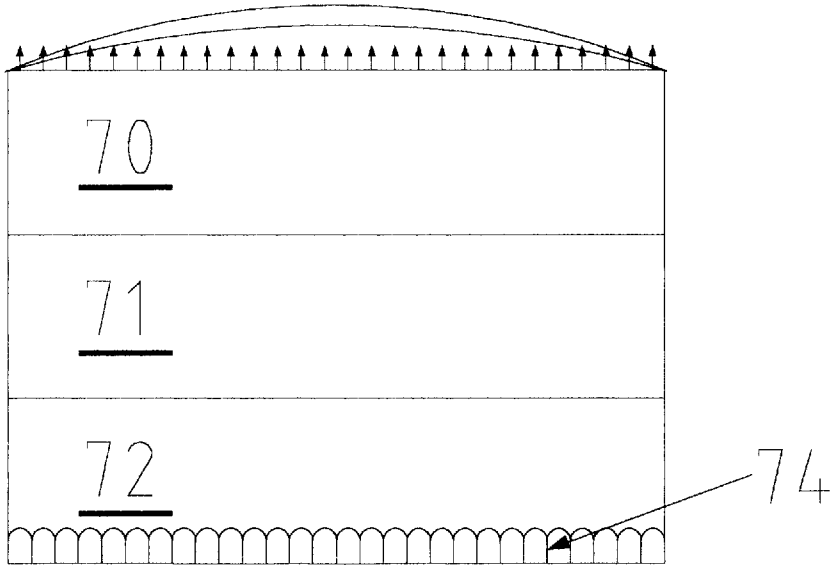

Referring to FIG. 10, a series of lamp modules 70, 71, 72 may be assembled in stacked array, wherein semi-reflective annular mirrors similar to those of FIG. 9 are provided. The lowermost module 72 may include a planar array 74 of LED's (shown in phantom), wherein their light can pass outwardly through the semi-mirrored reflectors, which reflectors 76 serve to reflect the light of their respective coplanar module outwardly in a generally polar direction.

Figure 11:
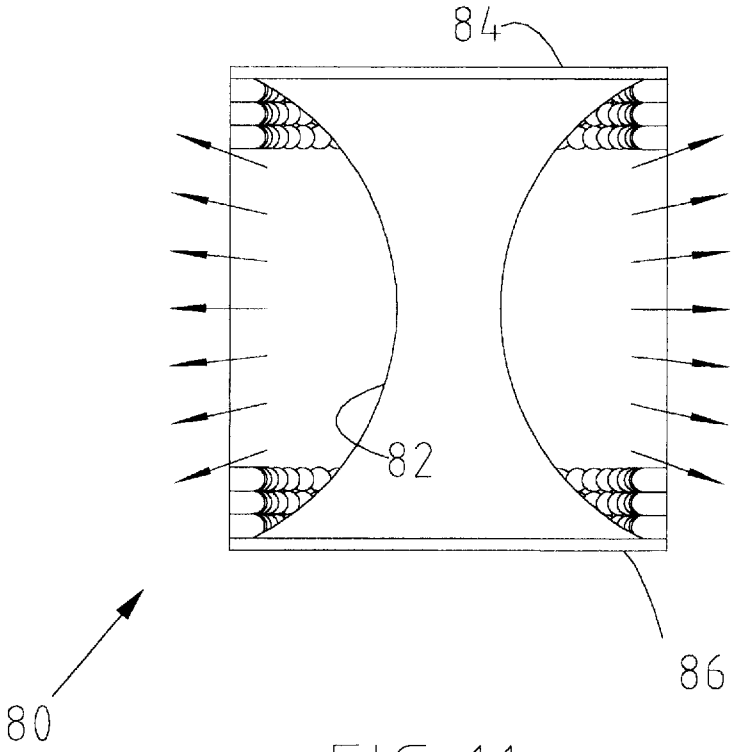

In the FIG. 11 embodiment a turret lamp 80 is illustrated as having an annular, parabolic mirror 82, with an annular upper lamp module 84 and a lower annular module 86, each of multiple LED lights 12. However, it will be understood that the annular mirror 82 may have conical surfaces; i.e. such as two frustum in back to back relation, or even a type of twin semi-pyrimidal reflector.

It will be understood that the lamp 80 provides 360 degrees of illumination. It is contemplated that, by the use of a semi-reflective mirror 82 supplementary LED lights may be located within the mirror 82, to boost the intensity and total light output of the turret lamp 80.

A preferred lamp construction utilizes a printed circuit, upon a flexible plastic base strip such as Mylar (Trademark), upon which the LED lights are solder mounted. A silver solder provides adequate strength to meet significant shock requirements. For less arduous duties a lead solder can be used, at less cost. A mechanically stapled or riveted arrangement also is contemplated, for ultra-high stress loadings.

At present LED lights appear best used to illuminate surfaces, such as the lenses of traffic lights.

The availability of coloured LED lights for the disclosed embodiments enables the provision of high efficiency coloured lamps, such as traffic lights, and special service indicators. The lamp and reflector arrangements shown herein may be used with forms of lighting other than LED's, to provide novel combinations.

It will be understood that the present invention may be modified to forms of the invention other than the presently disclosed embodiments, and lying within the scope of the claims of this invention.

PRACTICAL UTILIZATION

A wide range of practical applications for the invention exist, in replacing incandescent lights with high intensity LED-based lamps, where the higher prime cost is offset by longer life, greater reliability, lower heat generation and more rugged, shock-resistant construction.

What I claim by Letters Patent of the United States is:

1. A lamp for use in illumination having a polar axis of light propagation, and a projected frontal zone of light emission on substantially normal to said polar axis; a mass of solid state lights arranged in close mutual proximity as a strip lamp of predetermined width, the strip lamp being positioned at an angle to the plane of said frontal zone, the face area of said strip lamp exceeding the face area of said frontal zone, wherein said frontal zone cannot accomodate said mass of solid state lights of said strip lamp; said strip lamp providing a light source the intensity of which when energized exceeds the intensity of a Lamp comprising said solid state lights, lying in the plane of, and occupying said frontal zone.

2. The lamp as set forth in claim 1, said solid state lights comprising LED's.

3. The lamp as set forth in claim 2, wherein said lamp has a shaped body portion in facing relation with said frontal zone, said lights substantially occupying at least a major portion of the surface of said shaped body portion, said lights being interposed between said shaped body portion and said frontal zone, to emit light towards said frontal zone.

4. The lamp as set forth in claim 2, including directing means to direct light emitted by said LED lights in a direction substantially parallel to said polar axis.

5. The lamp as set forth in claim 4, having said strip of lights positioned about the periphery of said frontal zone, and positioned at an angle to the plane of said frontal zone.

6. The lamp as set forth in claim 4, said light directing means comprising reflector means within said lamp, inclined at an angle from said strip of LED lights to reflect the light emitted thereby in a direction substantially parallel with said lamp polar axis.

7. The lamp as set forth in claim 6, said strip of lights being positioned substantially normal to the plane of said frontal zone.

8. The lamp as set forth in claim 6, comprising a plurality of said strips, arranged in mutually concentric relation and having light reflector means located in interposed relation between the strips.

9. The lamp as set forth in claim 7, comprising a plurality of said strips, arranged in mutually concentric relation and having light reflector means located in interposed relation between the strips.

10. The lamp as set forth in claim 9, said light reflector means including a semi-reflector, permitting the passage of light therethrough.

11. A combination lamp having a unitary polar axis of light emission, and a unitary projected area of light output substantially normal to said polar axis, comprising a plurality of light modules in mutually superposed relation along said polar axis, each said module having massed LED lights, mounted in spaced, facing and light emitting relation with said polar axis of said lamp, and reflector means within said lamp to direct light emitted by said light modules to said light output area of said lamp.

12. The combination as set forth in claim 11, said reflector means being semi-reflective, to permit the passage therethrough of light of predetermined incidence.

13. The lamp as set forth in claim 1, wherein in use, said solid state lights emit coloured light.

14. The lamp as set forth in claim 13, in combination with a substantially clear lens, in use to emit said coloured light.

* * * * *